US006357189B2

(12) United States Patent
Schlisner

(10) Patent No.: US 6,357,189 B2
(45) **Date of Patent: *Mar. 19, 2002**

(54) WALL BASE

(75) Inventor: Dennis G. Schlisner, Benton City, WA (US)

(73) Assignee: Bind-N-Stix Twin Track, LLC, Kennewick, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/798,637

(22) Filed: Mar. 2, 2001

Related U.S. Application Data

(63) Continuation of application No. 09/420,467, filed on Oct. 19, 1999, now Pat. No. 6,195,957, which is a division of application No. 09/408,802, filed on Sep. 30, 1999, now Pat. No. 6,189,275, which is a continuation of application No. 09/239,845, filed on Jan. 29, 1999, now abandoned, which is a continuation of application No. 08/846,797, filed on Apr. 30, 1997, now abandoned.

(51) Int. Cl.[7] ..... E04F 19/04

(52) U.S. Cl. ..... 52/287.1; 52/716.1; 52/717.03; 52/717.04

(58) Field of Search ..... 52/287.1, 716.1, 52/716.3, 716.4, 717.03, 717.04, 717.05, 290; 428/41.8, 906

(56) References Cited

U.S. PATENT DOCUMENTS 1,990,701 A * 2/1935 Knight ..... 428/906 X
2,303,864 A * 12/1942 Reasor ..... 52/287.1 X
3,408,250 A * 10/1968 Finefrock ..... 52/287.1 X
3,475,871 A * 11/1969 Saunders et al. ..... 52/287.1 X
4,242,389 A * 12/1980 Howell ..... 428/41.9
4,418,120 A * 11/1983 Kealy et al. ..... 428/343
4,609,580 A * 9/1986 Rockett et al. ..... 428/198
4,730,432 A * 3/1988 Schäfer et al. ..... 52/716.1
4,849,267 A * 7/1989 Ward et al. ..... 428/906 X
4,988,551 A * 1/1991 Zegler ..... 428/906 X
5,088,126 A * 2/1992 Mathis ..... 2/181
5,088,252 A * 2/1992 Antekeier ..... 52/287.1
5,184,445 A * 2/1993 Hoopengardner ..... 52/741.1
5,212,923 A * 5/1993 Pelosi et al. ..... 52/287.1
5,450,698 A * 9/1995 Hoopengardner ..... 52/287.1
5,553,431 A * 9/1996 Pelosi, Jr. et al. ..... 52/287.1
5,595,041 A * 1/1997 Hoopengardner ..... 52/746.1
5,971,453 A * 10/1999 Schlisner ..... 294/8.6
6,189,275 B1 * 2/2001 Schlisner ..... 52/287.1
6,195,957 B1 * 3/2001 Schlisner ..... 52/745.21

FOREIGN PATENT DOCUMENTS

EP 580009 1/1994

* cited by examiner

*Primary Examiner*—Laura A. Callo
(74) *Attorney, Agent, or Firm*—Luedeka, Neely & Graham PC

(57) ABSTRACT

The specification describes a wall base which is preferably provided by an elongate strip of carpeting with a pair of spaced-apart strips of double-sided adhesive tape on the back of the strip of carpeting covered by a release liner. For a 3 to 6 inch wide carpet strip, the strips of adhesive tape are preferably spaced apart by a distance of from about ¼ inch to about 2 inches, one being positioned close by adjacent the top edge of the carpet strip and the other spaced from the bottom edge.

1 Claim, 4 Drawing Sheets

WALL BASE

This application is a continuation of application Ser. No. 09/420,467, filed Oct. 19, 1999 (which is to issue as U.S. Pat. No. 6,195,957 on Mar. 6, 2001), which is a divisional of U.S. application Ser. No. 09/408,802, filed Sep. 30, 1999 (issued as U.S. Pat. No. 6,189,275 on Feb. 20, 2001)), which is a continuation of application Ser. No. 09/239,845 filed Jan. 29, 1999 (abandoned), which is a continuation of Ser. No. 08/846,797 filed Apr. 30, 1997 (abandoned)).

This invention relates generally to wall bases used along the base of a wall to protect the lowermost part of the wall adjacent the wall-floor intersection, and for decorative purposes. More particularly, this invention relates to a wall base which is easier to mount and which more tenaciously adheres to vertical wall surfaces as compared to conventional bases.

Flooring wall bases are commonly provided by lengths of relatively rigid materials (e.g. wood or hard plastic) or flexible materials (e.g. flexible plastic, rubber, or strips of carpet) having widths of from about 3 to about 6 inches, most typically from about 3½ to about 5 inches. Such flooring bases are typically attached along the lowermost portions of a vertical wall adjacent the wall-floor intersection using fasteners such as nails or staples or an adhesive applied between the base and wall.

As will be appreciated, the use of fasteners to secure flooring bases is undesirable in that installation of the base using fasteners is very laborious and time consuming, the fasteners cause damage to the wall and the fasteners often remain visible and detract from tile appearance of the base requiring cosmetic measures to hide them from view. Conventional adhesive techniques for installing wall bases are also undesirable in that application of adhesive to the base is time consuming and messy and does not provide a reliable securement of the base. Attempts have been made to use adhesive tape, but with only limited success. Prior efforts with adhesive tape have resulted in generally poor adhesion and the bases tend to separate from the wall after a time.

Accordingly it is an object of tile present invention to provide an improved wall base and an improved method of installing a wall base.

A further object of the present invention is to provide a wall base which offers improved adherence to vertical wall surfaces.

Still another object of the present invention is to provide a wall base of the character of the character described which is uncomplicated in construction and is economical to make, use and install.

Yet another object of the invention is to provide an improved method for manufacturing a wall base which is readily installable as made.

With regard to the foregoing and other objects, the present invention is directed to a wall base construction which includes an elongate wall base member having generally planar front and back surfaces and a plurality of elongate laterally spaced apart adhesive members secured to the back surface disposed generally parallel to and along the length of the base member for securing the base member to the wall. The base member has a relatively wide, thin configuration with substantially linear elongate side edges. In a preferred embodiment, the adhesive members comprise a pair of elongate substantially parallel spaced apart strips of adhesive. One of the strips is positioned closely adjacent one of the side edges running generally continuously along the length thereof. The other strip is spaced laterally inwardly from the other side edge of the base member and from the strip positioned closely adjacent one of the side edges.

According to one aspect of the invention, the wall base member is an elongate strip of carpet having parallel side edges running along its length. A lower side edge is positionable along a wall/floor intersection. An upper side edge is finished in any suitable manner such as by binding for placement against the wall surface spaced vertically above the intersection and observable by viewers in the area. The carpet strip may have a relatively stiff backing onto which are applied a plurality of laterally spaced apart elongate adhesive elements disposed along the length of the carpet strip. Preferably, two such elements are used and include a first continuous adhesive strip on the backing closely adjacent the upper edge and a second continuous strip spaced from the lower side edge. Preferably a release liner is provided over the first and second adhesive strips.

An important aspect of the invention is the use of multiple strips of adhesive and the spaced apart relationship of the strips. It has been found, quite surprisingly, that the use of multiple strips of spaced apart adhesive provides superior adhesion on a carpet wall base as compared to a single strip of adhesive tape having a size that is the same or greater than the aggregate size of the multiple strips of tape. As an example, it has been found that use of two 1-inch tapes spaced apart on a 4 inch wide carpet wall base in accordance with the invention provides superior results as compared to a single strip of tape having a width of 2 inches or greater.

BRIEF DESCRIPTION OF THE DRAWINGS

The above and other features and advantages of the present invention will become further known from the following detailed description considered in conjunction with the accompanying drawings in which.

DETAILED DESCRIPTION

Figure 1:
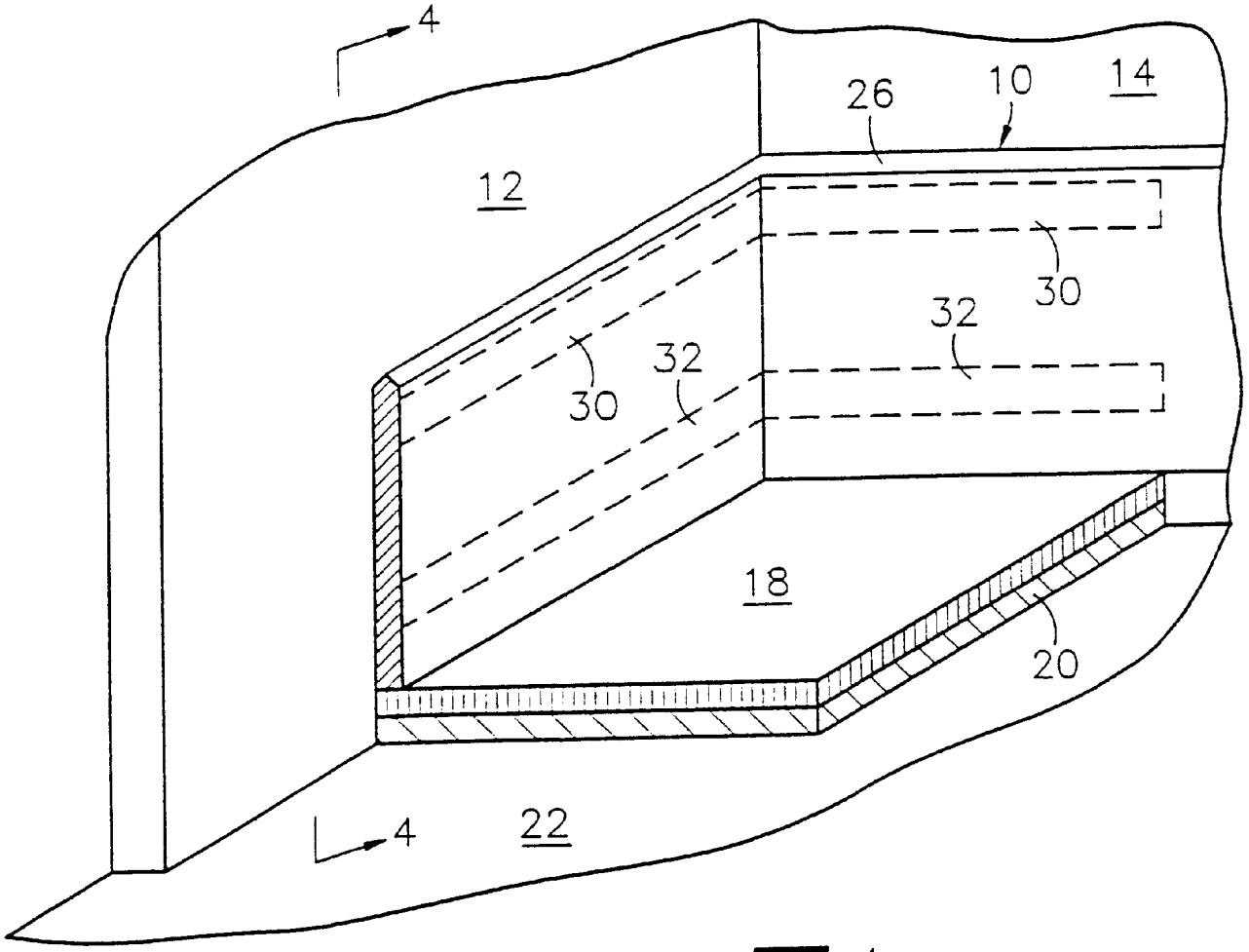
FIG. 1 is a perspective view showing a portion of a carpet wall base in accordance with the invention as installed with wall-to-wall carpeting.

With initial reference to FIG. 1, there is shown a carpet wall base 10 in accordance with one embodiment of the invention installed along the lowermost portion of vertical walls 12 and 14 adjacent the edges of horizontally disposed wall-to wall carpeting 18 to provide a decorative appearance. Conventionally, the wall-to-wall carpeting 18 overlies a carpet pad 20 which overlies a subflooring 22.

Figure 2:
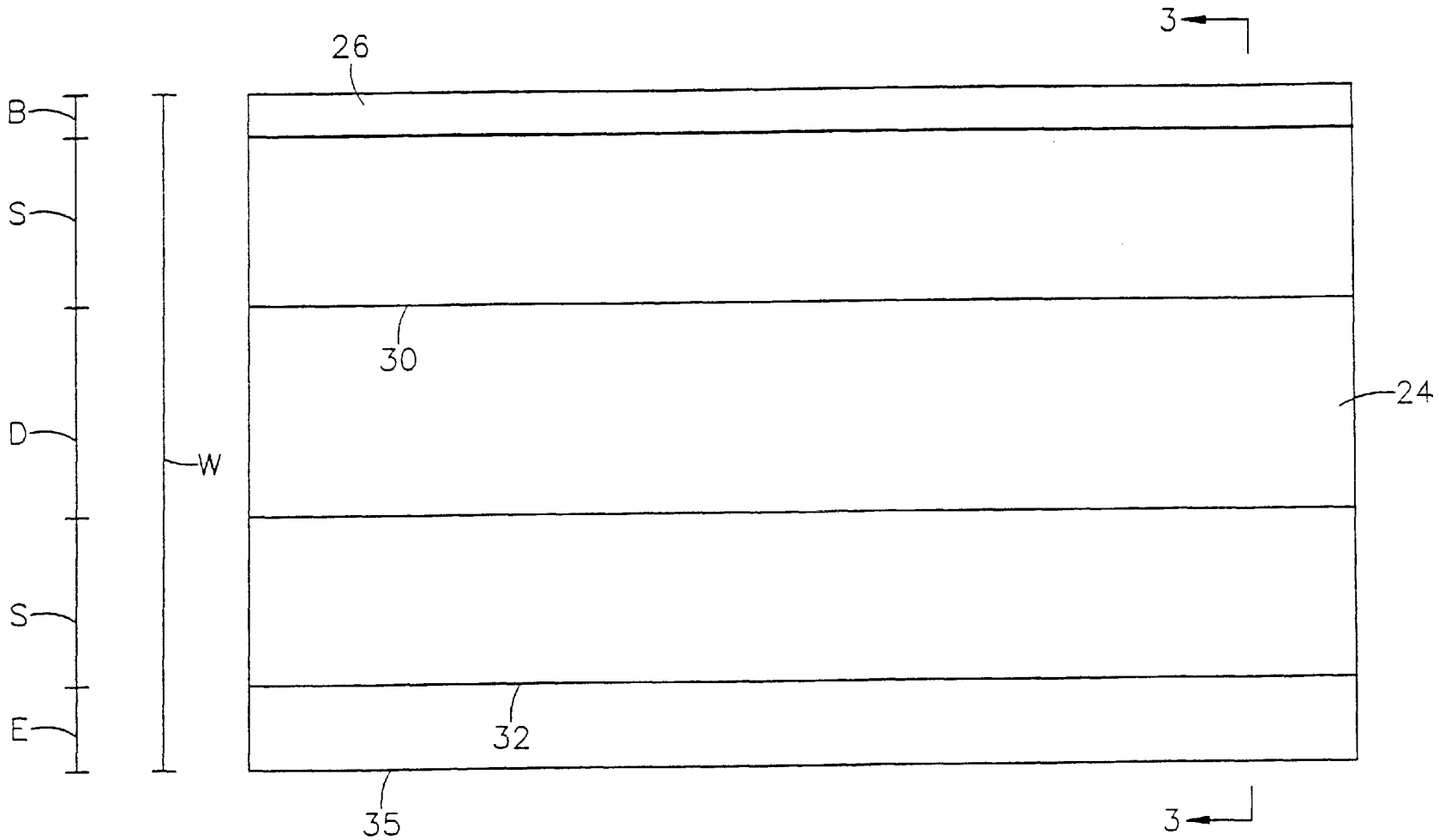
FIG. 2 is a top plan view of the back of a preferred embodiment of a carpet wall base provided in accordance with the present invention.
Figure 4:
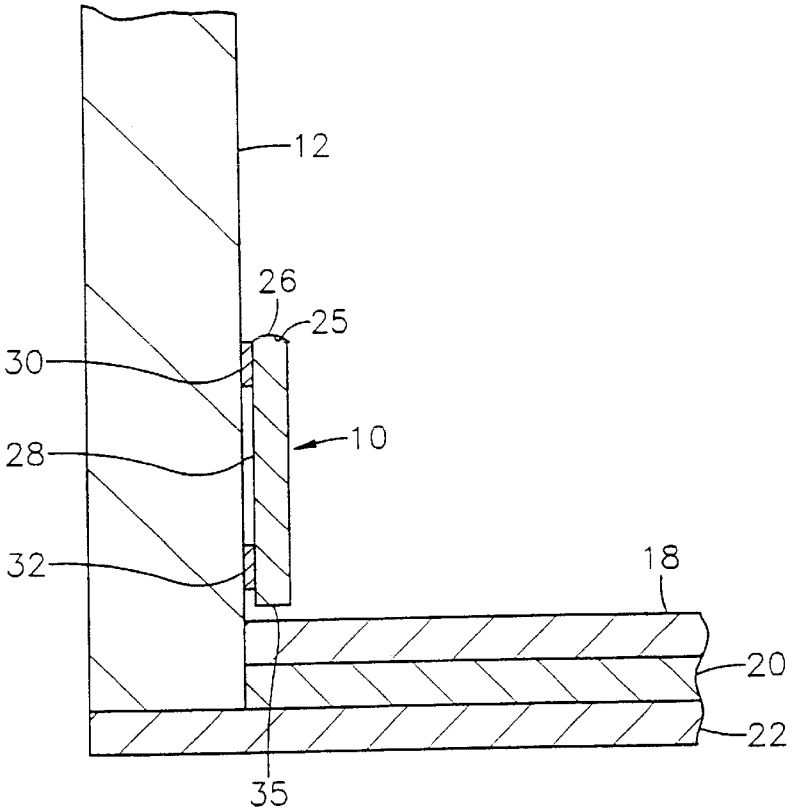
FIG. 4 is a cross-sectional view taken along line 4—4 of FIG. 1.
Figure 3A:
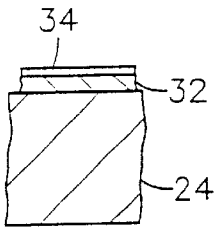
FIG. 3 is a cross-sectional view of the carpet wall base of FIG. 2 taken along line 3—3 and FIG. 3*a* is an enlarged view of a portion of the flooring base of FIG. 3.
Figure 3:
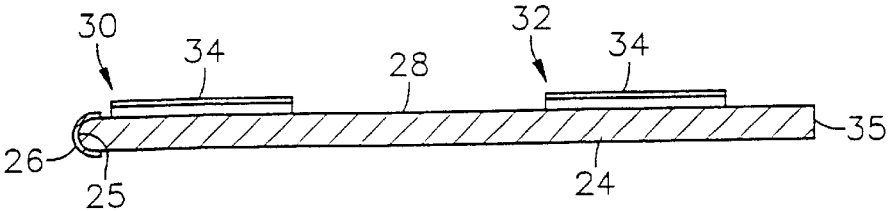

With additional reference to FIGS. 2–4, the base 10 is preferably provided by an elongate strip of carpeting material 24 having a width W of from about 3 to about 6 inches, most preferably about 4 inches, and having a length corresponding to the length of the wall on which the base will be installed. The thickness of material 24 will typically range from about ¼ to about ¾ inches.

It will be understood that while the base 10 may be provided in one continuous length, a plurality of smaller segments may be placed end-to-end or one above the other to provide the desired coverage along the wall 14.

Upper edge 25 of the carpet material 24 is preferably finished with a binding material 26 in a manner well known in the art to provide an aesthetically pleasing appearance to the base (to cover a cut edge) and to avoid unraveling or fraying of the upper edge. The width B of the covered portion of the base 10 is preferably about ¼ inch.

The material 24 may be made of any substance commonly used as a wall base or baseboard material, and is preferably provided by an elongate strip of carpeting which matches carpeting 18 and has been cut to the desired length and width. When base 10 is supplied as a carpet strip, it will typically contain a relatively stiff backing provided by a resin-impregnated or coated open-weave fabric commonly referred to as reinforced latex which supports the carpet fibers in an upright configuration relative to the backing and supports the overall carpet structure in a planar, spread out configuration which resists buckling, bulging, creasing or wrinkling. Such carpeting materials typically have a face weight of from about 16 to about 60 oz/yd$^2$. The carpet backing may be any of the various other backings common to carpet, such as jute, rubber, woven, so-called "action back" or the like.

While the preferred embodiments are described herein in relation to wall bases made using carpet material, it will be understood that the invention may find application with other wall base materials such as vinyl or synthetic wall bases or wood or wood/resin composite wall bases and various types of baseboard moldings. In general, base 10 may have a wide range of widths and thicknesses typically such bases will have a width ranging from about 2½" to about 10" and a thickness which may or may not be uniform ranging from about 1/16" to about ¾". In addition, the base 10 may be used with other flooring, such as linoleum, tile, cement or wood floors.

Backside surface 28 of the base 10 which is to be positioned adjacent the walls 12 and 14 includes a pair of spaced apart, parallel adhesive strips 30 and 32. In general, backside 28 is substantially planar for the various embodiments of base 10 so as to enable placement of the base with strips 30, 32 thereon flat against the wall surface.

The strips 30 and 32 are preferably provided by identical continuous strips of double sided adhesive tape each preferably having a length corresponding to the length of the base and, as an example, for a base having a width of 4 inches, the strips each would have a width S of from about ¼ inch to about 2 inches, most preferably about 1 inch. Strips 30, 32 are preferably of uniform width and thickness. A preferred double-sided adhesive tape is a 1 inch wide double-sided polyacrylic adhesive tape available under the tradename JANTAC from Janser of Benton Harbor, Mich. The strips may be applied to the backside 28 of the base 10 by hand or machine using known techniques and equipment for applying double sided adhesive tape to roll or sheet material.

One side of each strip 30 and 32 is adhesively secured to the backside 28 of the base 10 and the other side of each strip is covered with a pull-away release liner strip 34. The release liners 34 which may be silicon-coated unbleached kraft paper having a basis weight of about 90 lbs/3000 ft$^2$ are removed when the base 10 is ready to be secured to a wall surface as explained below. While separate release liner strips 34 are shown, it is understood that one release liner wide enough to cover both adhesive strips 30, 32 until installation may be used.

For 1-inch wide adhesive strips and a 4-inch wide base, the strips 30 and 32 are preferably spaced apart a distance D of at least about ¼ inch, preferably from about ¾ to about 1 and ½ inches, and most preferably about 1 and ¼ inches. Strip 30 is preferably placed closely adjacent the top edge 25 of the base 10, just below the bottom edge of the binding material 26, and strip 32 is spaced a distance E of from about ¼" to about ¾" from bottom edge 35 of the base 10, most preferably about ½" inches. For wider or narrower base members, it will be understood that the exemplary dimensions given herein for the strips 30 and 32 and their relative spacing may be used as a guide for determining the proper placement.

Figure 5:
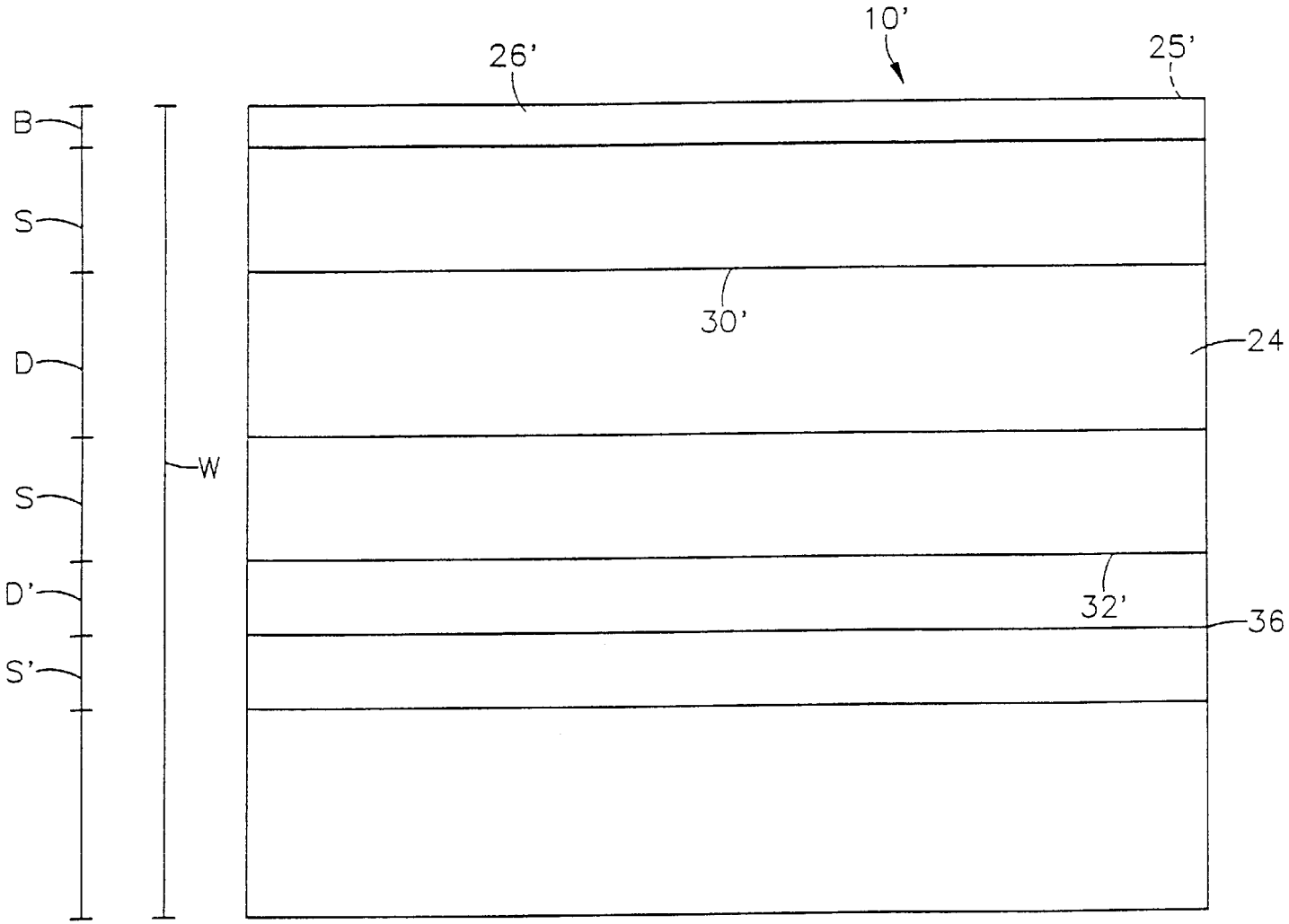
FIG. 5 is a top plan view of the back of a section of another embodiment of a carpet wall base provided in accordance with the present invention.

As will be appreciated, more than two strips of tape may be used provided they are spaced apart and positioned in accordance with the invention. For example, with reference to FIG. 5 there is shown another embodiment of a wall base 10' made of carpeting material 24' having a width W' of about 6 inches which includes strips 30' and 32' each having a width S of about 1 inch each and spaced a distance D apart of about 1 inch with strip 30 closely adjacent binding material 26 along upper edge 25. A further adhesive strip 36 having a width S' of about ½ inch and spaced a distance D' of about ½ inch below the strip 32' supplied by the same material as strips 30', 32', and all strips 30', 32' and 36 are preferably covered by a release liner to protect them from adhering to other surfaces until base 10' is ready to be installed.

It has been found that the invention has an unexpected synergistic effect and provides superior adhesion of a wall base to the wall as compared to the use of glue or of a single width of tape regardless of the width of the tape. For example, a wall base in accordance with the invention having two 1 inch strips spaced apart as described herein has been observed to provide superior attachment of the base member to a wall as compared to a base coated with glue or having a single width of tape of 1 inch width, 2 inch width or greater.

In addition, wall bases provided in accordance with the invention offer improved ease of installation as compared to conventional wall bases. For example, a wall base having two strips is easier to install than a wall base having one strip of greater or equal width or to which glue has been applied in that the position of the base of the invention may be more easily adjusted when initially placed against the wall, yet is more secure once installation is complete. As will be appreciated, this ability to adjust the position of the base during installation enables a more precise installation of the base to provide a more aesthetically pleasing appearance.

The wall base 10 is preferably secured along the lower part of the wall after a flooring such as wall-to-wall carpeting has been installed. The base 10 may be applied from a roll thereof by pulling off a first short length of the base and removing the release liner to expose the adhesive. The base with the exposed adhesive strips is positioned at the desired location against the wall at a starting point such as at the corner between two walls with the lower edge at the wall-floor intersection and slight hand pressure is applied to initially press the strips 30 and 32 against the wall. The base 10 is then unrolled to the end of the wall under hand tension to stretch the base slightly. Slight hand pressure is preferably applied to the outer surface of the base during this process to secure the base to the wall as the base is unrolled. Adjustments may then be made to the position of the base by hand to position the base evenly along the wall and firm pressure applied by hand-or a suitable tool such as a roller or the like to finally fix the position of the base.

A carpet tractor may be used to further press the base against the wall and the corners of the base tucked under the edge of the carpeting by use of a tucking knife or stair tool. If desired, fasteners, such as staples may be used at the corners for additional securement.

The foregoing description of certain exemplary embodiments of the present invention has been provided for purposes of illustration only, and it is understood that numerous modifications or alterations may be made in and to the illustrated embodiments without departing from the spirit and scope of the invention as defined in the following claims.

What is claimed is:

1. A wall base system securable to a wall surface, the wall base system comprising an elongate strip of carpeting having a face weight of from about 16 to about 60 ounces per yard, and two strips of a double-sided polyacrylic adhesive tape secured to a back surface of the carpeting strip, the strips being spaced apart by a distance of from about 1 to about 2 inches, with one of the strips being positioned closely adjacent to an upper longitudinal edge of the carpet strip.

* * * * *